United States Patent [19]

Hoyme

[11] Patent Number: 4,538,980

[45] Date of Patent: Sep. 3, 1985

[54] POSITIVE OPENING DAMPER FOR COMBUSTION APPLIANCE

[76] Inventor: Clifford L. Hoyme, P.O. Box 1485, Camrose, Alberta, Canada, T4V 1X3

[21] Appl. No.: 506,882

[22] Filed: Jun. 21, 1983

Related U.S. Application Data

[63] Continuation-in-part of Ser. No. 225,729, Jan. 15, 1981, Pat. No. 4,426,993.

[51] Int. Cl.[3] ..... F24C 3/00

[52] U.S. Cl. ..... 431/20; 236/1 G; 126/85 B; 126/285 R

[58] Field of Search ..... 431/20; 126/285 B, 285 R, 126/292, 289, 85 B; 236/1 G

[56] References Cited

U.S. PATENT DOCUMENTS

| | | | |
|---|---|---|---|
| 1,193,271 | 8/1916 | Kuntz | 236/1 G |
| 4,039,123 | 8/1977 | Frankel | 126/285 B |
| 4,079,884 | 3/1978 | Sherman | 431/20 |
| 4,185,769 | 1/1980 | Nezworski | 236/1 H |
| 4,193,541 | 3/1980 | Scheidweiler | 431/20 |
| 4,205,783 | 6/1980 | Dietsche | 431/20 |
| 4,251,024 | 2/1981 | Feinberg | 236/1 G |
| 4,426,993 | 1/1984 | Hoyme | 126/85 B |

*Primary Examiner*—Samuel Scott
*Assistant Examiner*—Helen A. Odar
*Attorney, Agent, or Firm*—Harvey B. Jacobson

[57] ABSTRACT

A normally energized motor maintains a counterbalanced damper closed to block air inflow in a non-combustion condition of an appliance. Deenergization of the motor by thermostat control releases a rotor for displacement through a limited angular stroke. Through a lost-motion linkage connection the damper is displaced, in lagging relation to the rotor to the open position. The open position of the damper is detected by a sensor to open a fuel valve in the appliance.

17 Claims, 12 Drawing Figures

POSITIVE OPENING DAMPER FOR COMBUSTION APPLIANCE

BACKGROUND OF THE INVENTION

The present invention relates to improvements in a control system for combustion-type appliances as disclosed and claimed in my prior copending application, U.S. Ser. No. 225,729, filed Jan. 15, 1981, now U.S. Pat. No. 4,426,993, with respect to which the present application is a continuation-in-part.

According to my prior copending application, a damper is held closed during non-combustion periods of an appliance by a counterweight, the damper being pivotally suspended by a swingable pivot fixed to an inlet air duct adjacent its lower open end which is blocked by the damper in its closed position. A solenoid is energized to displace the damper toward an open position through a lost-motion connection. The lost-motion connection includes a damper mounted spring biasing the damper to the open position in lagging relation to movement of the solenoid armature through a full power stroke. At the end of its stroke, the armature closes a limit switch to energize a fuel valve during a combustion period while the damper is open to admit a supply of air.

SUMMARY OF THE INVENTION

In accordance with the present invention, the damper is displaced to the open position under a spring bias in response to deenergization of a motor operatively connected to a rotor forming part of a non binding lost-motion connection to the damper. The lost-motion connection includes a connecting link having a pivot end slidable within a slot formed in the rotor. A centering spring mounted within the rotor biases the pivot end of the connecting link to a central static position in the rotor slot so as to exert the aforementioned opening bias on the damper to displace the damper with a shock-absorbing action to the open position. A feeler element pivotally connected directly to the damper is operative to actuate a sensor switch when the damper reaches the open position after the motor is deenergized. Actuation of the sensor switch energizes the fuel valve only when a relay is energized in response to closing of a thermostat switch to effect said deenergization of the motor.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
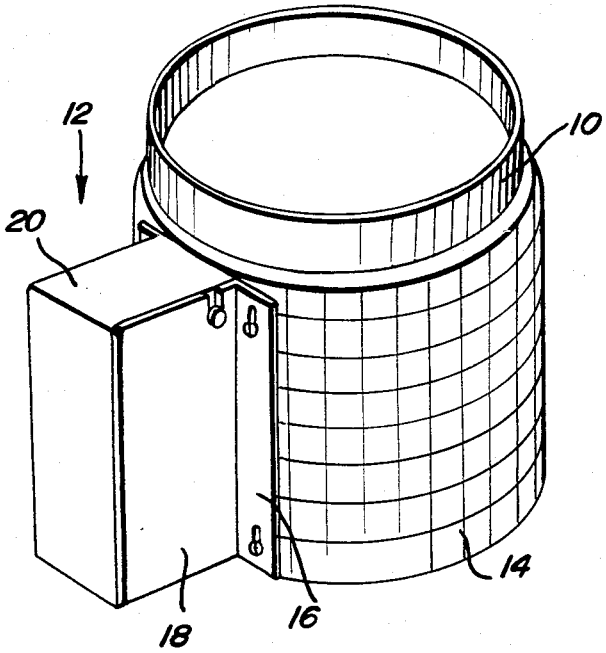
FIG. 1 is perspective view showing a typical control unit for a combustion appliance in accordance with the present invention.

Referring now to the drawings in detail, FIG. 1 illustrates an inlet section 10 of an air supply duct for a combustion type of appliance. A control unit 12 is mounted on duct section 10 in accordance with the present invention. The duct section 10 shown is generally cylindrical and has an insulation layer 14 on its outer surface to which the unit 12 is secured through mounting flanges 16 of a pair of parallel spaced bracket plates 18. A housing cover 20 is secured to and bridges the bracket plates 18 to form a housing enclosure for the unit 12.

Figure 2:
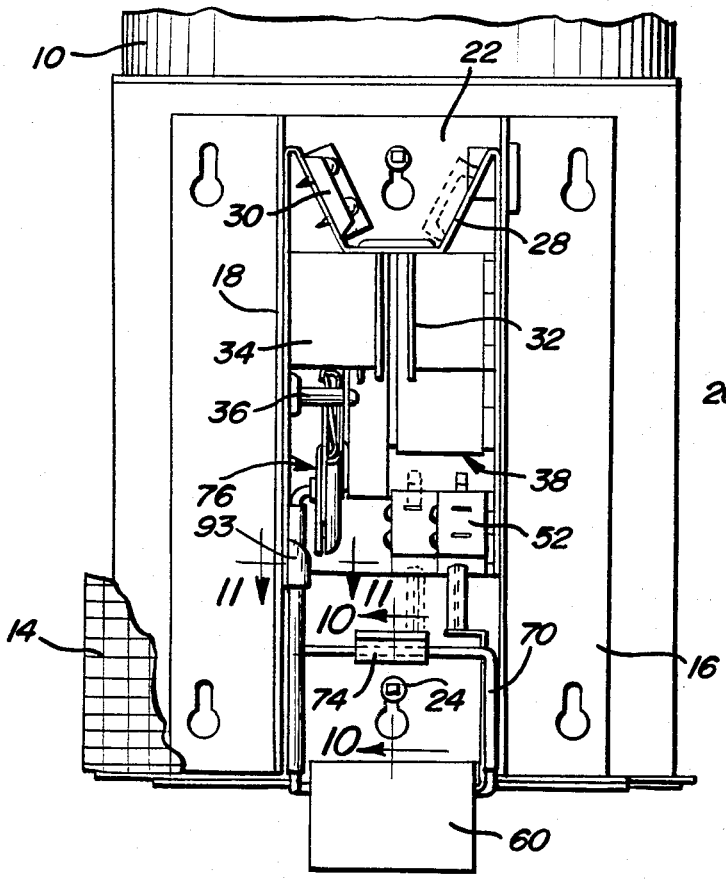
FIG. 2 is a front elevational view of the control unit shown in FIG. 1, with the housing cover removed.
Figure 11:
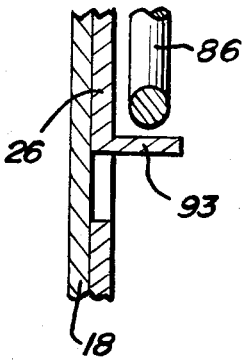
FIGS. 10 and 11 are enlarged partial sectional views taken substantially through planes indicated by section lines 10—10 and 11—11 in FIG. 3.
Figure 3:
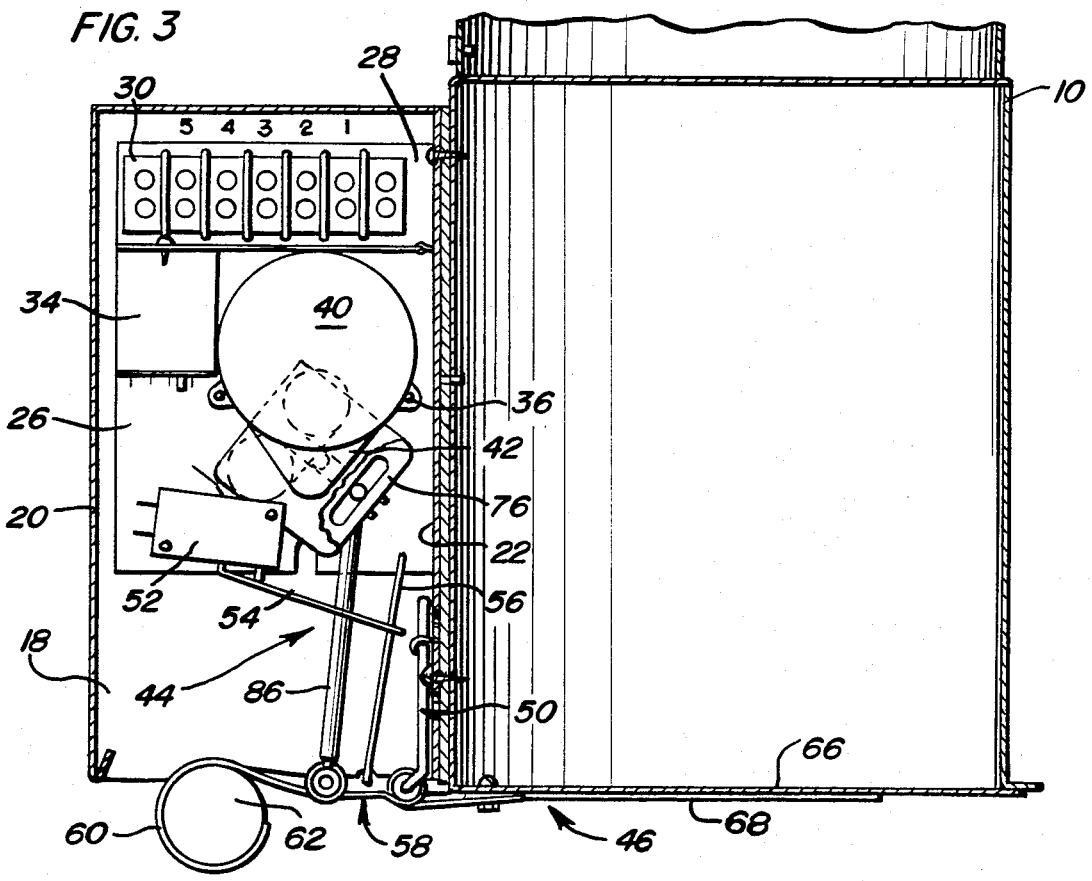
FIG. 3 is a side sectional view of the control unit and inlet duct section, shown in FIG. 1, with the damper in a closed position.

As shown in FIGS. 2 and 3, the unit housing encloses a mounting plate 22 secured to the duct section 10 between the brackets 18 by fasteners 24 extending through key slots located adjacent the upper and lower ends of the plate 22. A support frame 26 is interconnected between the brackets 18 and has an upper portion 28 on which at least one electrical terminal block 30 is mounted. Depending from the upper frame portion 28 is a mounting clamp 32 supporting at least one relay assembly 34. Also secured by spacers 36 to the support frame is an electrically powered operating mechanism 38 having a powered motor portion 40 and an output drive portion 42 through which an angular motion output is produced having a limited operating stroke. The powered operating mechanism 38 is operatively connected by a lost-motion type of transmitting linkage 44 to a damper control assembly 46 at the lower end of unit 12, the lower end being substantially coplanar with a lower open end 48 of the duct section 10. A pivot assembly 50 supports the damper control assembly 46 on the duct section adjacent the lower end 48 and is enclosed within the housing of unit 12 below support frame 26. Movement of the damper control assembly between open and closed positions is monitored by position sensing means including at least one microswitch 52 mounted on the support frame and having an actuator element 54 projecting downwardly therefrom for engagement with a feeler element 56 pivotally connected directly to the damper control assembly 46.

Figure 10:
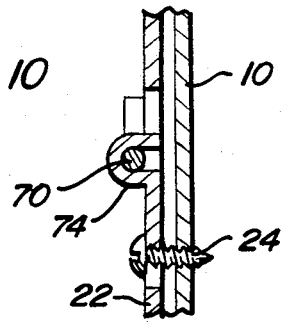
Figure 12:
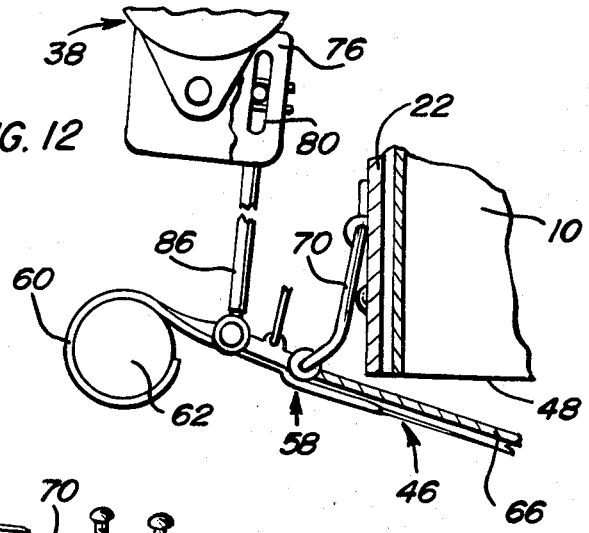
FIG. 12 is a partial side sectional view of a portion of the control unit as shown in FIG. 3, but with the damper in an open position.
Figure 6:
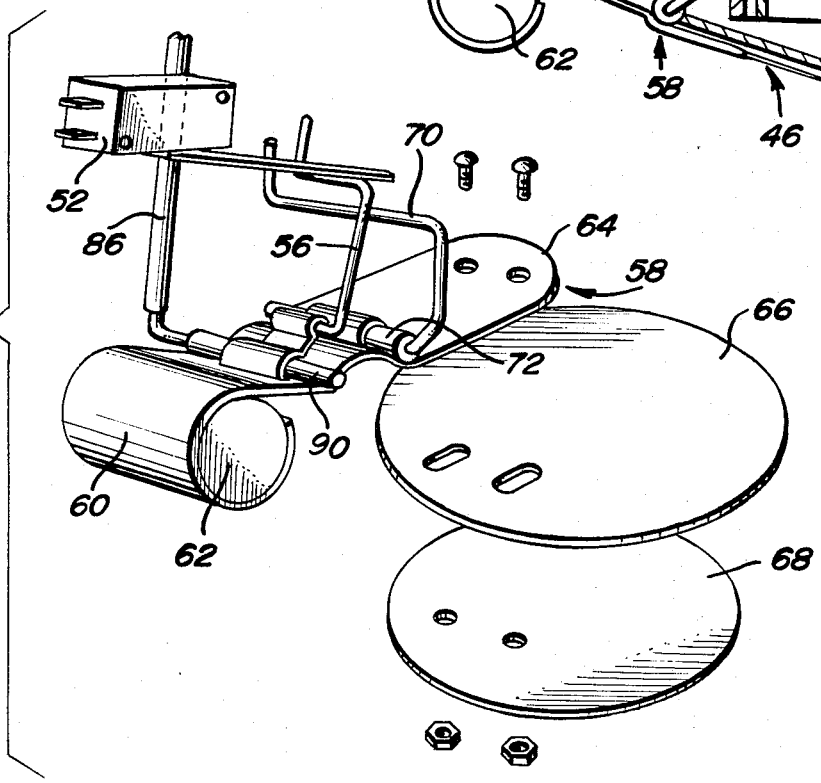
FIG. 6 is a perspective view of disassembled portions of the control unit.
Figure 7:
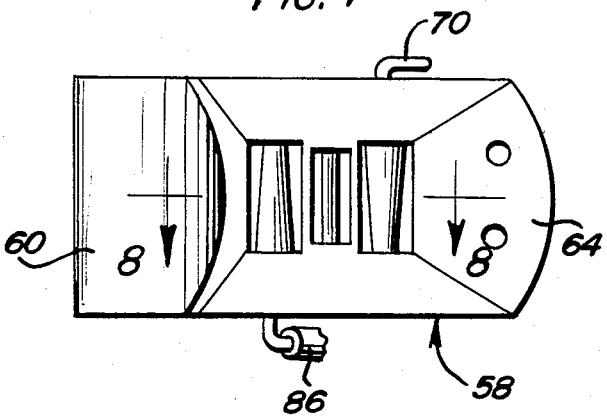
FIG. 7 is a bottom plan view of the damper operating lever associated with the control unit.
Figure 8:
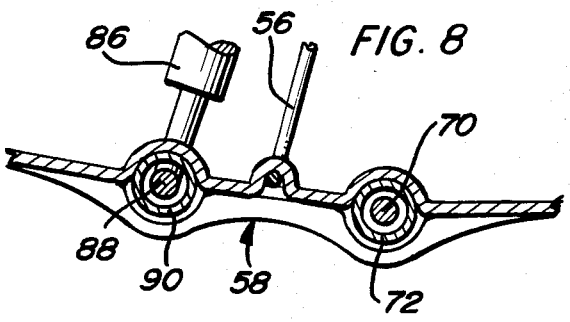
FIG. 8 is a sectional view taken substantially through a plane indicated by section line 8—8 in FIG. 7.

As more clearly seen in FIGS. 3, 6, 7 and 8, the damper control assembly 46 comprises an operating lever 58 having a curved end portion 60 embracing a cylindrical counterweight 62. The other end portion 64 of the lever is rigidly secured by fasteners to a circular damper element 66 and an underlying stiffener plate 68. The damper element in the closed position as shown in FIG. 3, completely blocks the lower open end 48 of the duct section 10. The damper assembly is supported in such closed position by he pivot assembly 50 which includes a suspension link 70 having a lower portion extending through a tapered sleeve 72 fixed to the lever 58. The upper portion of link 70 extends in parallel spaced relation to the lower portion through a bearing sleeve formation 74 struck out of the mounting plate 22 as more clearly seen in FIG. 10. Thus, the suspension link 70 may swing from the position shown in FIG. 3 abutting the mounting plate 22 to a position displaced therefrom when supporting the damper control assembly in an open position as shown in FIG. 12.

Figure 5:
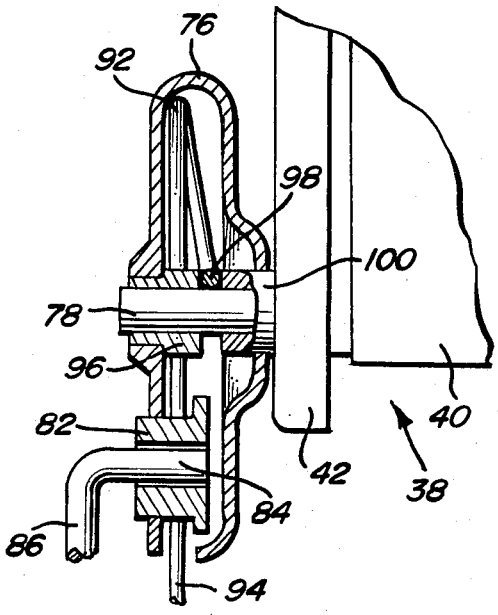
FIG. 5 is a side sectional view taken subsantially through a plane indicated by section line 5—5 in FIG. 4.
Figure 4:
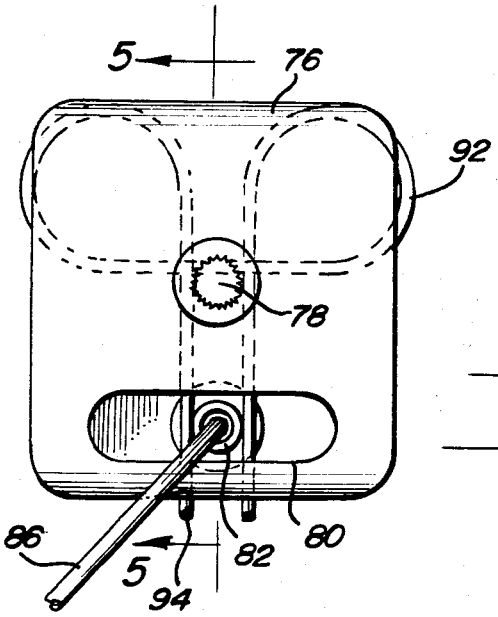
FIG. 4 is a front elevational view of the rotor assembly associated with the control unit of FIGS. 1-3.

The damper control asembly 46 is displaced between the closed and open positions by the limited stroke operation of powered operating mechanism 38 through the lost-motion transmitting linkage 44. The linkage 44 includes a generally rectangular rotor 76 fixed to the output shaft 78 of the drive 42. One face of the rotor is formed with an elongated slot 80 as more clearly seen in FIGS. 4 and 5. A bearing bushing 82 is slidably mounted in the slot and receives the upper pivot end portion 84 of a connecting link 86. The lower pivot end portion 88 of the connecting link is received in a tapered bearing sleeve 90 fixed to the operating lever 58 between the end portion 60 and bearing sleeve 72 through which the lever is fulcrummed by the pivot assembly 50. The bushing 82 is yieldably held in a central static position in slot 80 by a centering spring 92 enclosed in the rotor 76. Two parallel spaced end portions 94 of the spring engage the bushing 82 and straddle a cylindrical spline element 96 press-fitted onto the output shaft 78 of the drive portion 42 of the powered operating mechanism. The spring 92 forms loops between the end portions 94 and a transverse connecting portion 98 engaging the power shaft 78 axially between spline element 96 and the hub 100 of drive portion 42 through which the power shaft extends. It will be apparent that angular displacement of the rotor, secured by spline element 96 to shaft 78, will transmit motion to connecting link 86 through centering spring 92 to cause displacement of damper assembly 46 in lagging relation to the angular motion of rotor 76 because of the lost-motion connection formed by slot 80 and bushing 82 and the shock-absorbing action of the centering spring. A stop formation 93 on the support frame 26, limits overtravel of link 86 during displacement of the damper assembly. Displacement of the damper assembly is furthermore effected in response to energization or deenergization of motor 40 of the powered operating mechanism 38 causing power shaft 78 to displace the rotor through an angular stroke between limit positions as respectively shown in FIGS. 3 and 12. Such displacement of the damper element 66 to the open position occurs in delayed response to deenergization of motor 40 when the combustion appliance is turned on.

Figure 9:
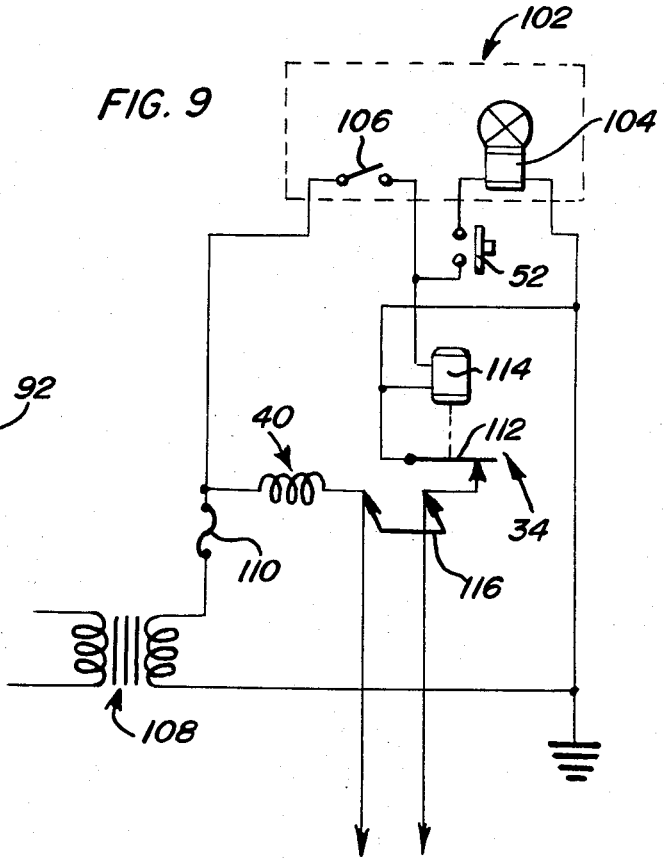
FIG. 9 is an electrical circuit diagram showing the operational relationships between the control unit and components of an associated combustion appliance.

FIG. 9 illustrates the power circuit associated with control unit 12 representing the wiring interconnecting unit 12 through the electrical terminal block 30 aforementioned and components of a combustion appliance 102 schematically shown in dotted line. The appliance includes a solenoid operated fuel valve 104 and a thermostat 106 of conventional types. The circuit is designed to interrelate operation of the damper with the appliance to insure an inflow of fresh air during periods of combustion and shut off air inflow during normal non-combustion periods and during power failure. The circuit is connected to a source of AC voltage through a ransformer 108, one output terminal of which is connected through fuse 110 to the appliance thermostat 106 and to the motor 40. The motor is maintained energized through a normally closed relay switch 112 of the relay assembly 34 to hold the damper closed as shown in FIG. 3. The thermostat switch 106 is closed to initiate operation of the appliance 102 by energizing the relay coil 114 of the relay 34 causing its relay switch 112 to open. The motor 40 is thereby deenergized to effect opening of the damper as hereinbefore described. Only when such opening of the damper occurs, as detected by closing of the sensor switch 52, is the solenoid operated fuel valve 104 energized to open and effect firing of the combustion appliance.

The circuit described with respect to FIG. 9 operationally interlocks one combustion appliance with the damper. If a secondary appliance also having a thermostat and solenoid operated fuel valve is to be served, a second circuit similar to that of FIG. 9 may be utilized with a second relay and a second sensor switch to similarly interrelate operation of the thermostat and fuel valve of the secondary appliance with the same damper and its operating motor 40. In such case, the relay switches of both relays are interconnected in series between ground and the motor 40 by removal of a jumper connection 116 as shown in FIG. 9.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a control system for a combustion appliance including a fuel valve, a duct and a damper element movable between open and closed positions relative to the duct, the improvement comprising pivot means movably mounted on the duct for pivotally suspending the damper element, a motor, lost-motion transmitting means operatively connected to the motor and driven thereby through an operating stroke for movement of the damper element toward the open position in lagging relation to movement of the motor, and means engageable with the lost motion transmitting means for yieldably displacing said damper element to the open position in delayed response to movement of the motor and the lost motion transmitting means through said operating stroke thereof.

2. The improvement as defined in claim 1 wherein said lost-motion transmitting means comprises a rotor undergoing limited angular displacement during said operating stroke, said rotor having a slot formed therein, a connecting link pivotally connected to the damper element, and bearing means slidably mounted in the slot of the rotor for pivotally connecting the link to a movable pivot point on the rotor.

3. The improvement as defined in claim 2 wherein said yieldable displacing means comprises centering spring means for urging the movable pivot point to a static position in the slot of the rotor at which the link holds the damper element in either the open or closed positions respectively corresponding to deenergized and energized conditions of the motor.

4. The improvement as defined in claim 3 including sensing means for detecting the damper element in the open position, power circuit means for opening the fuel valve in response to said detection of the open position of the damper element, and relay means for placing the motor in the deenergized condition causing delayed movement of the damper element to the open position.

5. The improvement as defined in claim 4 wherein the pivot means comprises a pivotal support suspended from the duct, and an operating lever pivotally mounted on said support, said damper element being rigidly connected to the operating lever and said connecting link being pivotally connected to the operating lever.

6. The improvement as defined in claim 5 wherein said sensing means comprises at least one sensor switch connected to the power circuit means, said sensor switch having an actuating element projecting therefrom, and a feeler element pivotally connected to the operating lever in engagement with the actuating element of the sensor switch.

7. The improvement as defined in claim 1 including sensing means for detecting the damper element in the open position, power circuit means for opening the fuel valve in response to said detection of the open position of the damper element, and relay means for deenergizing the motor causing delayed movment of the damper element to the open position through the lost-motion transmitting means.

8. The improvement as defined in claim 7 wherein said lost-motion transmitting means comprises a rotor undergoing limited angular displacement during said operating stroke, said rotor having a slot formed therein, a connecting link pivotally connected to the damper element and bearing means slidably mounted in the slot of the rotor for pivotally connecting the link to the rotor.

9. The improvement as defined in claim 7 wherein the pivot means comprises a pivotal support suspended from the duct, and an operating lever pivotally mounted on said support, said damper element being rigidly connected to the operating lever and said connecting link being pivotally connected to the operating lever.

10. The improvement as defined in claim 9 wherein said sensing means comprises at least one sensor switch connected to the power circuit means, said sensor switch having an actuating element projecting therefrom, and a feeler element pivotally connected to the operating lever in engagement with the actuating element of the sensor switch.

11. The improvement as defined in claim 2 wherein the pivot means comprises a pivotal support suspended from the duct, and an operating lever pivotally mounted on said support, said damper element being rigidly connected to the operating lever and said connecting link being pivotally connected to the operating lever.

12. The improvement as defined in claim 11 wherein said sensing means comprises at least one sensor switch having an actuating element projecting therefrom, and a feeler element pivotally connected to the operating lever in engagement with the actuating element of the sensor switch.

13. The combination of claim 1 wherein said duct has an open end, said pivotal suspending means mounting the damper element externally on the duct adjacent to the open end thereof for movement between said open and closed positions relative to the open end.

14. In combination with a control system for a combustion appliance including a fuel valve, an air supply duct having an open end, a damper pivotally displaceable between open and closed positions relative to the open end of the duct, electrically energized operating means for effecting displacement of the damper between said open and closed positions, and thermostatically controlled relay means for deenergizing the operating means, the improvement comprising yieldable transmitting means operatively connecting the operating means to the damper for displacement thereof to the open position in delayed response to deenergization of the operating means through the relay means, and sensing means responsive to detection of the damper in the open position during said deenergization of the operating means for opening the fuel valve.

15. The improvement as defined in claim 14 wherein the operating means includes a motor imparting movement to the transmitting means through a limited angular stroke.

16. The improvement as defined in claim 15 wherein the yieldable transmitting means comprises a rotor connected to the motor having a slot therein, a connecting link extending from the damper, bearing means slidable in the slot of the rotor for pivotal connection of the rotor to the connecting link, and centering spring means biasing the bearing means to a static position in the slot for effecting said displacement of the damper to the open position following said deenergization of the electrical operating means.

17. In combination with a combustion air supply duct including an outlet end, a mount carried by one side of said outlet end, pivot means defining a pivot axis disposed outwardly of and adjacent said one side of said outlet end and swingably supported from said mount for lateral shifting outwardly away from and back toward said one end, a damper plate, said damper plate including an outwardly projecting lever arm from one end of which said damper plate is supported, a portion of said lever arm intermediate its opposite ends being supported for swinging oscillation about said axis with said lever arm disposed transverse to said axis and said damper plate being swingable with said lever arm into and out of position extending across and closing said outlet end, and a thermostat electrical circuit controllable motor operatively connected with the other end of said lever arm by lost motion connecting means for swinging said other end in an upstream direction relative to said outlet end responsive to actuation of said motor, said connecting means operatively connecting said motor to said other end of said lever arm by a lost motion connection therewith wherein full movement of the lever arm to the damper plate open position may lag relative to full actuation of said motor to open said damper plate, said connecting means including a rotor connected to the motor and having a slot formed therein, a link pivotally connected to the damper plate and having an end portion slidably mounted in the rotor slot, said slot and end portion of the link constituting said lost motion connection, and spring means engaging the end portion of the link within the rotor slot for yieldably biasing said lever arm to a position with said damper plate in the open position responsive to full actuation of said motor.

* * * * *